US010633222B2

(12) United States Patent
Fauconnet et al.

(10) Patent No.: US 10,633,222 B2
(45) Date of Patent: Apr. 28, 2020

(54) REMOVABLE ELEVATOR CAR DOOR PANEL

(71) Applicant: Otis Elevator Company, Farmington, CT (US)

(72) Inventors: Aurelien Fauconnet, Isdes (FR); Amine Badaoui, Briare (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 245 days.

(21) Appl. No.: 15/573,569

(22) PCT Filed: Jun. 19, 2015

(86) PCT No.: PCT/IB2015/001178
§ 371 (c)(1),
(2) Date: Nov. 13, 2017

(87) PCT Pub. No.: WO2016/203284
PCT Pub. Date: Dec. 22, 2016

(65) Prior Publication Data

US 2018/0127243 A1 May 10, 2018

(51) Int. Cl.
*B66B 13/30* (2006.01)
*B66B 5/00* (2006.01)

(52) U.S. Cl.
CPC ..... *B66B 13/303* (2013.01); *B66B 5/0087* (2013.01)

(58) Field of Classification Search
CPC ..... B66B 13/303; B66B 5/0087
See application file for complete search history.

(56) References Cited

U.S. PATENT DOCUMENTS 4,199,907 A * 4/1980 Bains ..... B66B 11/0253 52/122.1
4,357,993 A * 11/1982 Halpern ..... B66B 11/0253 187/401

(Continued)

FOREIGN PATENT DOCUMENTS

CN 203229299 U 10/2013
EP 1031528 A1 8/2000

(Continued)

OTHER PUBLICATIONS

International Search Report, International Application No. PCT/IB2015/001178, dated Feb. 26, 2016, European Patent Office; International Search Report 6 pages.

(Continued)

*Primary Examiner* — Michael A Riegelman
(74) *Attorney, Agent, or Firm* — Cantor Colburn LLP

(57) ABSTRACT

An elevator car door system is provided, the system including an elevator car door panel (502, 600, 704) having a first retention member (510, 604, 720) and a suspension (504, 602, 706) having a second retention member (512, 606, 718) configured to releasably engage with the first retention member (510, 604, 720) to retain the elevator car door panel (502, 600, 704) in a first position. The elevator car door panel (502, 600, 704) is movable relative to the suspension (504, 602, 706) to a second position, wherein the second position is configured to enable the elevator car door panel (502, 600, 704) to be removed from the suspension (504, 602, 706).

10 Claims, 10 Drawing Sheets

(56) References Cited

U.S. PATENT DOCUMENTS

| | | | | |
|---|---|---|---|---|
| 5,327,682 | A * | 7/1994 | Holtz | E04F 19/08 16/254 |
| 5,454,449 | A * | 10/1995 | Makimattila | B66B 11/0226 187/401 |
| 7,578,095 | B2 * | 8/2009 | Peters | E05B 65/1033 49/141 |
| 8,302,808 | B2 * | 11/2012 | Lin | E05D 7/123 16/229 |
| 8,573,367 | B2 * | 11/2013 | Henseler | B66B 5/005 187/401 |
| 8,869,458 | B2 * | 10/2014 | Ivasiv | E05C 3/042 49/503 |
| 8,931,662 | B2 * | 1/2015 | Bradley | E05D 7/1005 220/254.3 |
| 9,193,566 | B1 * | 11/2015 | Nieves | B66B 11/0226 |
| 9,546,078 | B2 * | 1/2017 | Paasisalo | B66B 11/0226 |
| 2003/0015378 | A1 * | 1/2003 | Elsener | B66B 11/0246 187/336 |
| 2010/0038183 | A1 * | 2/2010 | Henseler | B66B 11/0246 187/276 |
| 2012/0255815 | A1 * | 10/2012 | Koskelainen | B66B 5/027 187/401 |
| 2014/0224591 | A1 * | 8/2014 | Garcia | B66B 11/0005 187/251 |
| 2015/0175388 | A1 * | 6/2015 | Klappholz | B66B 11/0226 187/401 |
| 2017/0144863 | A1 * | 5/2017 | Minami | B66B 11/0253 |
| 2017/0297870 | A1 * | 10/2017 | Fauconnet | B66B 11/0246 |
| 2018/0072538 | A1 * | 3/2018 | Fauconnet | B66B 11/0253 |
| 2018/0086604 | A1 * | 3/2018 | Fonteneau | B66B 11/0246 |
| 2018/0105394 | A1 * | 4/2018 | Hill | B66B 11/0226 |
| 2018/0105395 | A1 * | 4/2018 | Cortes | B66B 11/0246 |
| 2018/0111797 | A1 * | 4/2018 | Fauconnet | B66B 11/0253 |
| 2018/0127243 | A1 * | 5/2018 | Fauconnet | B66B 5/0087 |
| 2018/0208437 | A1 * | 7/2018 | Durand | B66B 11/0253 |
| 2018/0222723 | A1 * | 8/2018 | Gressien | B66B 5/0087 |
| 2018/0282127 | A1 * | 10/2018 | Fauconnet | B66B 11/0246 |
| 2018/0297817 | A1 * | 10/2018 | Fernandez | B66B 11/0253 |

FOREIGN PATENT DOCUMENTS

| | | | |
|---|---|---|---|
| EP | 1246770 | B1 | 7/2003 |
| EP | 2114810 | B1 | 2/2008 |
| EP | 2681145 | B1 | 2/2011 |
| EP | 2690050 | A1 | 1/2014 |
| JP | S5554278 | A | 4/1980 |
| JP | S571260 | U | 1/1982 |
| JP | S601869 | U | 1/1985 |
| JP | 6475391 | A | 3/1989 |
| JP | H010231074 | A | 9/1989 |
| JP | 2007031109 | A | 2/2007 |
| JP | 2008195523 | A | 8/2008 |
| JP | 2011068428 | A | 4/2011 |
| WO | 0127017 | A1 | 4/2001 |
| WO | 2001079104 | A1 | 10/2001 |
| WO | 2006064307 | A1 | 6/2006 |
| WO | 2014122358 | A1 | 8/2014 |

OTHER PUBLICATIONS

International Written Opinion, International Application No. PCT/IB2015/001178, dated Feb. 26, 2016, European Patent Office; International Written Opinion 7 pages.

* cited by examiner 610
608
C
C
606
604
606
604
606
604
602
612
600

602
606
612
600

610
608
602
606
606
604
604
604
612
600

REMOVABLE ELEVATOR CAR DOOR PANEL

CROSS REFERENCE TO RELATED APPLICATIONS

This is a U.S. National Stage of Application No. PCT/IB2015/001178, filed on Jun. 19, 2015, the disclosure of which is incorporated herein by reference.

BACKGROUND

The subject matter disclosed herein generally relates to elevator car door panels and, more particularly, to mechanisms and methods for removing elevator car door panels.

Current elevator or lift systems, during installation and/or maintenance, may require adjustment of the doors of the cars and/or the doors of the landing floor or components thereof. Such adjustment may be performed to ensure the proper function of the car and landing door. During operation, when an elevator reaches a landing, a component, such as an elevator car door coupling of an elevator door, will engage with a component of the landing door, such as a landing door lock. The motion for opening and closing door panels of an elevator car door is generated by an elevator car door motor that activates a sliding motion of the elevator car door panels and the landing door panel when the elevator car door coupling is in front of the landing door lock. As such, when the elevator car door opens, the landing door will also open simultaneously. The alignment of these components must be set or adjusted by a technician, mechanic, etc., during installation and/or during maintenance.

Traditionally, car and landing doors, and components thereof, are adjusted from the top of car and consequently a safety volume on the top of the car is needed to permit the technician/mechanic to safely work. The adjustment may be performed during an installation phase of the elevator and may also be performed during maintenance which may be initiated due to wear on elevator systems, such as the guidance systems, or due to settling of the building. The adjustment may consist of setting the alignment between a car door coupling and a landing door lock at each level with an accuracy close to ±1 mm. The alignment operation is performed with both the elevator car doors and the landing doors closed and adjacent or proximal to each other. A technician or mechanic may then access the components of the doors for alignment from the top of car in order to have a direct view of the clearance between the car door coupling and landing door lock.

SUMMARY

According to one embodiment an elevator car door system is provided. The system includes an elevator car door panel having a first retention member and a suspension having a second retention member configured to releasably engage with the first retention member to retain the elevator car door panel in a first position. The elevator car door panel is moveable relative to the suspension to a second position, wherein the second position is configured to enable the elevator car door panel to be removed from the suspension.

In addition to one or more of the features described above, or as an alternative, further embodiments may include that one of the first retention member and the second retention member is at least one fastener.

In addition to one or more of the features described above, or as an alternative, further embodiments may include that the other of the first retention member and the second retention member is at least one aperture.

In addition to one or more of the features described above, or as an alternative, further embodiments may include that the at least one aperture includes a first width and a second width, wherein the first width is larger than the second width, and wherein the first width is sized to permit the at least one fastener to pass therethrough and the second width is sized to prevent the at least one fastener to pass therethrough.

In addition to one or more of the features described above, or as an alternative, further embodiments may include that the first retention member and the second retention member form an electromechanical link between the car door panel and the suspension.

In addition to one or more of the features described above, or as an alternative, further embodiments may include that the number of first retention members equals the number of second retention members.

In addition to one or more of the features described above, or as an alternative, further embodiments may include that the first retention member is a locking tie.

In addition to one or more of the features described above, or as an alternative, further embodiments may include that the suspension further comprises a stop element configured to assist in the placement of the elevator car door panel relative to the suspension.

In addition to one or more of the features described above, or as an alternative, further embodiments may include a locking member configured to secure the elevator car door panel to the suspension in the first position.

In addition to one or more of the features described above, or as an alternative, further embodiments may include that at least one of the first retention member and the second retention member is accessible from an inside of an elevator car.

According to another embodiment, a method of operating an elevator car door is provided. The method includes sliding an elevator car door panel having a first retention member relative to a suspension having a second retention member from a first position to a second position and removing the elevator car door panel from the suspension when the elevator car door panel is in the second position.

In addition to one or more of the features of the method described above, or as an alternative, further embodiments may include that the first retention member is a locking tie, wherein the method further comprises removing the locking tie prior to sliding the elevator car door panel.

In addition to one or more of the features of the method described above, or as an alternative, further embodiments may include that one of the first retention member and the second retention member is at least one fastener.

In addition to one or more of the features of the method described above, or as an alternative, further embodiments may include that the other of the first retention member and the second retention member is at least one aperture.

In addition to one or more of the features of the method described above, or as an alternative, further embodiments may include that the at least one aperture includes a first width and a second width, wherein the first width is larger than the second width, and wherein the first width is sized to permit the at least one fastener to pass therethrough and the second width is sized to prevent the at least one fastener to pass therethrough.

In addition to one or more of the features of the method described above, or as an alternative, further embodiments may include that when sliding the elevator car panel from the first position to the second position, the at least one fastener moves from the first width of the aperture to the second width of the aperture.

In addition to one or more of the features of the method described above, or as an alternative, further embodiments may include removing a locking member configured to secure the elevator car door panel to the suspension in the first position prior to sliding the elevator car door panel.

In addition to one or more of the features of the method described above, or as an alternative, further embodiments may include that the method is performed from within the elevator car.

Technical effects of embodiments of the present disclosure include providing mechanisms for removing elevator car door panels to enable maintenance operations on an elevator car and/or landing door from the inside of an elevator car. Further technical effects include minimizing and/or eliminating safety spaces within elevator shafts.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

During operation of an elevator car within a hoistway or elevator shaft, the car doors of the elevator car and the doors at a landing or floor open simultaneously. When an elevator car reaches a floor or landing, the operation of the elevator car door(s) acts upon the landing door(s), such that both sets of doors open and close together. This is achieved by one or more couplings, such as blades, vanes, etc. installed on an elevator car door suspension of one or more elevator car doors. One or more landing door locks are disposed within the elevator shaft. The landing door lock may be configured as locks, rollers, etc. that are configured to coact with the car door coupling such that the doors operate (open/close) in tandem.

To ensure proper door operation, the coupling of the elevator car and the locks of the landing doors must be aligned. The alignment is necessary so that the doors will operate together when opening and closing. The alignment is also important when an elevator car passes a landing door without stopping. That is, the car door coupling must be able to pass the landing door lock when the elevator car is moving within the elevator shaft without interference or contact between the coupling and the locks.

Figure 1B:
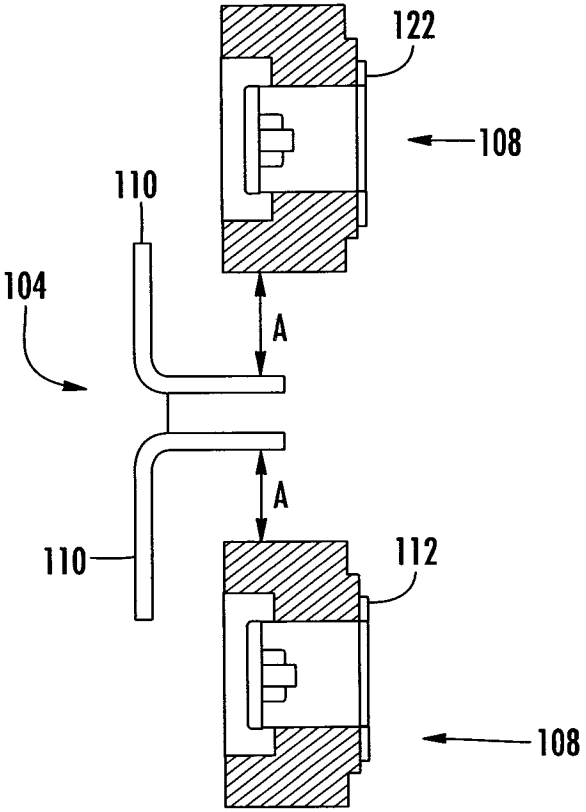
FIG. 1B is an enlarged schematic view of a portion of the elevator car and landing door of FIG. 1A.
Figure 1A:
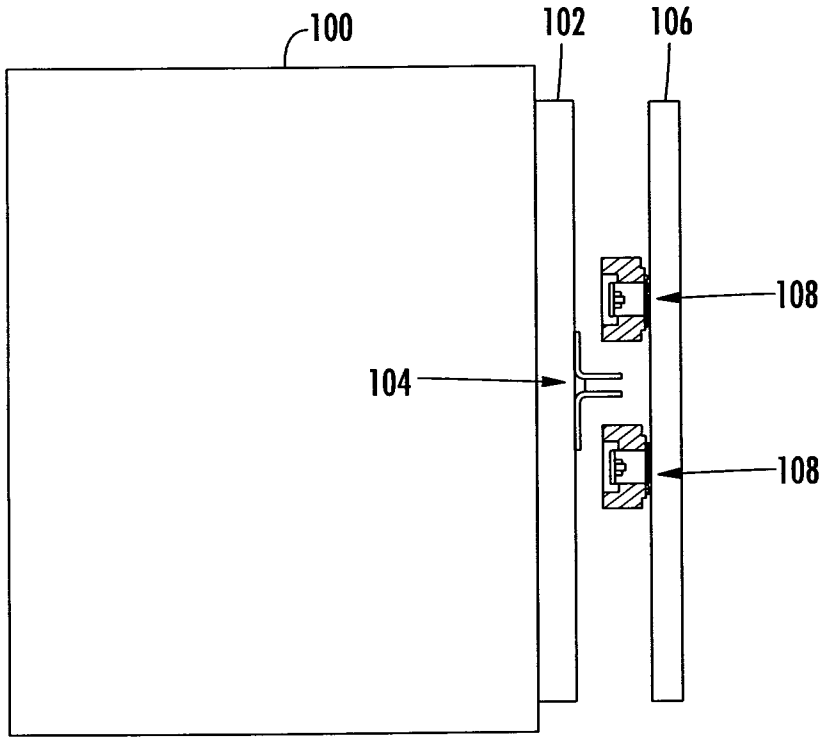
FIG. 1A is a top-down schematic view of an elevator car and landing door.

With reference to FIGS. 1A and 1B, a top down view of an elevator car and landing door is shown. The elevator car 100 has a car door 102 which includes a car door coupling 104 and may include one or more car door panels and associated components. On the landing side there is a landing door 106 and a landing door lock 108. The car door coupling 104 and the landing door lock 108 coact to enable the car door 102 and the landing door 106 to operate simultaneously to open and close. As noted above, the car door coupling 104 and the landing door lock 108 must be aligned for proper operation of the elevator system.

As shown in more detail in FIG. 1B, the car door coupling 104 includes two blades 110 which are disposed between elements 112 of the landing door lock 108, as known in the art. For example, in some embodiments, the landing door lock elements 112 may be configured as two rollers with an adjustable distance between axles made with an eccentric system. As shown, the clearance A between each blade 110 and the adjacent landing door lock element 112 must be adjusted to desired or appropriate clearances for elevator operation. That is, the spacing, i.e., clearance A, must be sufficiently narrow or close for proper engagement during door opening/closing, but must be sufficiently wide or far apart to allow for the blades 110 to pass between the landing door lock elements 112 when the elevator car 100 does not stop at the particular landing door 106.

Figure 2B:
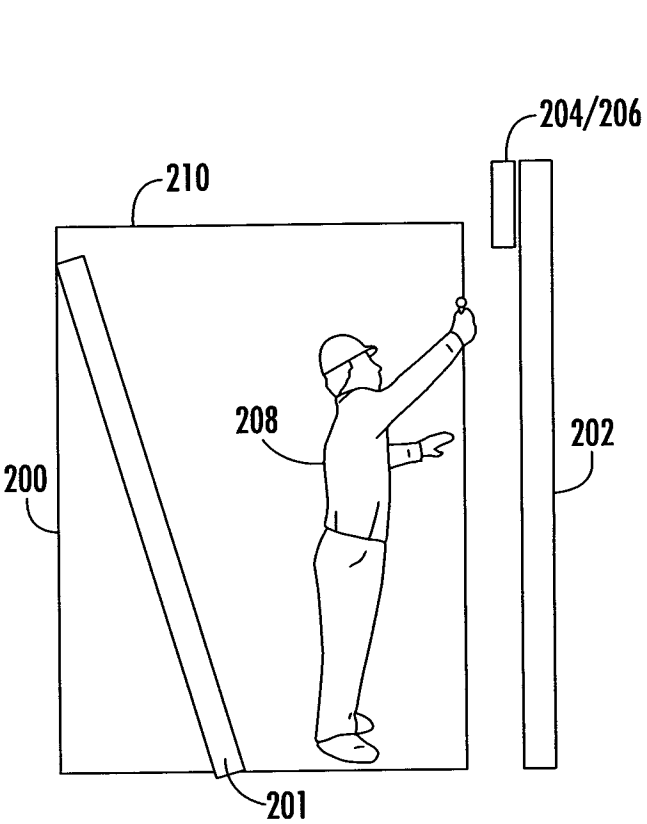
FIG. 2B is a schematic side view of an operation performed in accordance with an exemplary embodiment of the disclosure.
Figure 2A:
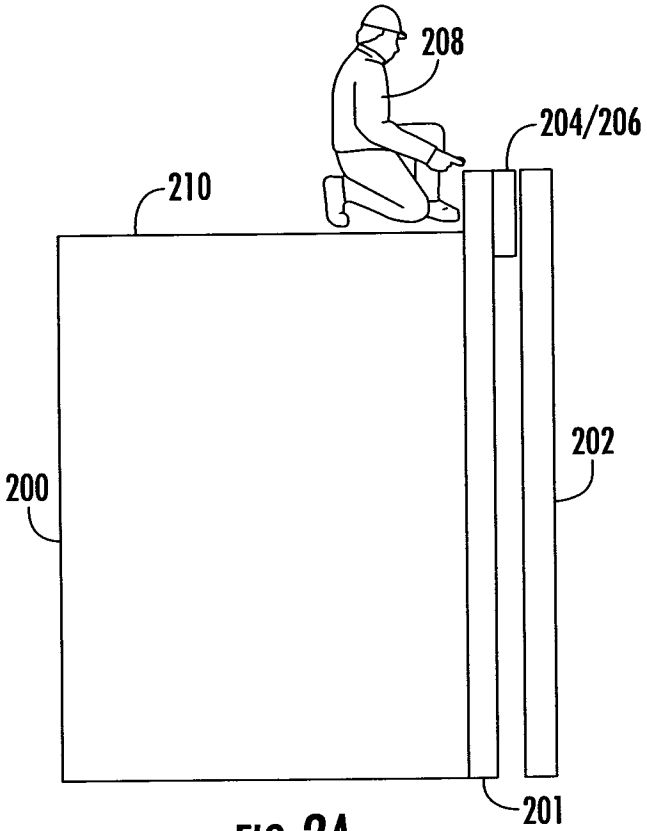
FIG. 2A is a schematic side view of a traditional operation performed during alignment and adjustment of elevator car door coupling and landing door lock.

Referring now to FIGS. 2A and 2B, side view schematic illustrations of the adjustment of an elevator door coupling is shown. FIG. 2A shows an elevator car 200 having a car door 201 relative to a landing door 202 as configured during normal operation and indicating the traditional method of adjusting the couplings. FIG. 2B shows an exemplary configuration of the disclosure, illustrating a user, such as a technician, mechanic, etc., adjusting a landing door lock from inside the elevator car 200. Traditionally, as shown in FIG. 2A, the adjustment of the couplings was made from on top 210 of the elevator car 200 where a technician could visibly see and physically access a car door coupling 204 and a landing door lock 206 at the same time. That is, the technician would access the car door coupling 204 and the landing door lock 206 when the two elements were near or proximal to each other, i.e., in positions that approximate or represent operational positions of the doors.

As such, under prior processes, a technician 208 would be located on the top 210 of the elevator car 200, where the car door coupling 204 and the landing door lock 206 are located such that any adjustments may be made to the landing door lock 206 relative to the car door coupling 204. After an adjustment process, the technician 208 would then have to get off the top 210 of the elevator car 200 or operate the elevator car 200 in an inspection mode to move the elevator car 200 to another landing to perform a second adjustment at the second landing, and this would be repeated for each floor/landing of an elevator shaft.

However, as shown in FIG. 2B, such a process is not necessary when embodiments of the disclosure are employed. The technician 208 may access and perform an alignment procedure on the landing door lock 206 from within the elevator car 200. As shown, in contrast to FIG. 2A, the car door coupling 204 and the landing door lock 206 are accessible from inside the elevator car 200. This is enabled by the technician 208 removing the elevator car door 201, or panels thereof, from an elevator car frame. As shown in FIG. 2B, the elevator car door 201 may be stored within the elevator car 200 and the opening of the elevator car door 201 is aligned with the landing door 202 such that the technician 208 can easily access the top of the landing door 202 where the landing door lock 206 and the car door coupling 204 are located. As such, the technician 208 does not need to be located outside of or on the top of the elevator car 200 to perform the alignment between the car door coupling 204 and the landing door lock 206.

Figure 3:
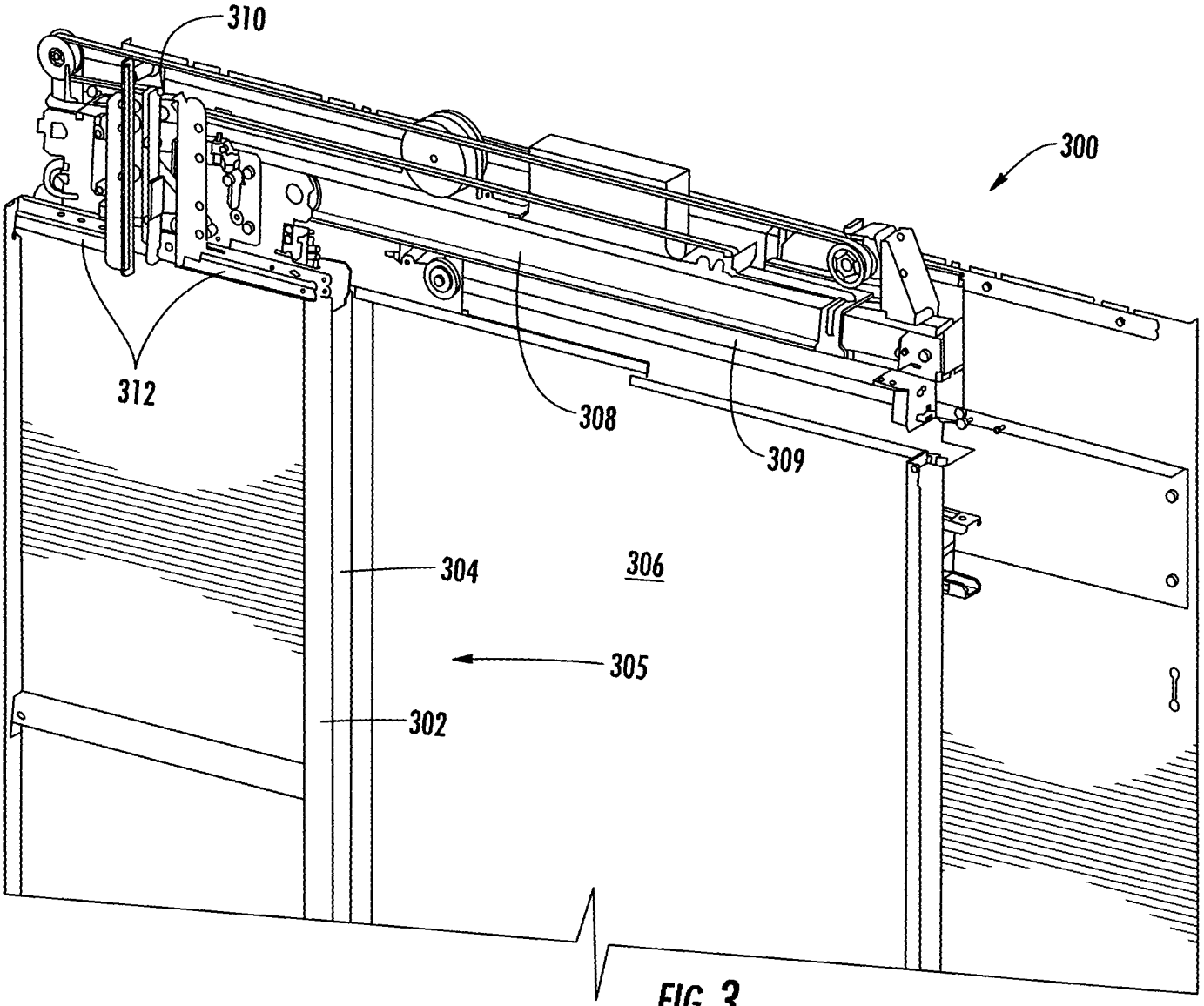
FIG. 3 is a schematic view of an elevator car door system in accordance with an embodiment of the disclosure.

Turning now to FIG. 3, a first embodiment of the present disclosure is shown that is configured to enable removal of elevator car doors or panels thereof from within the elevator car, thus enabling maintenance and adjustments from within the elevator car. In FIG. 3, an elevator car 300 is shown with both a first elevator car door panel 302 and a second elevator car door panel 304 shown in an open position and forming an elevator car door 305 defining an opening 306. The elevator car door 305 may include one or more panels, suspensions, fasteners, car door locking/unlocking mechanisms, track runners, suspension trolley, rails, etc. Although not shown, those of skill in the art will appreciate that a landing door and associated components may be in the open position as well.

The elevator car door panels 302, 304 are retained at the top of the elevator car 300 along an elevator car door rail 308 mounted to a lintel 309. The elevator car door panels 302, 304 may slidably move along the elevator car door rail 308 on a suspension trolley 310 or other similar mechanism that supports suspensions (see, e.g., FIG. 5) that operably connect the elevator car door panels 302, 304 to the suspension trolley 310. In traditional configurations, the elevator car door panels 302, 304 are fixedly mounted and retained with respect to the suspension trolley 310 by means of the suspensions such that when the suspension trolley 310 moves, the panels 302, 304 will slidably move and open to form the opening 306, or close to shut the opening 306.

However, as shown in FIG. 3, a first retention member 312, such as a locking tie, is configured to removably attach the elevator car door panels 302, 304 to the suspensions that are attached to the suspension trolley 310 and the elevator car door rail 308. Each elevator car door panel 302, 304 may be removably retained or attached by a first retention member 312. In some embodiments, each first retention member 312 may be defined as a bar or similar rod that slides along the top of the elevator car door panel 302, 304. A second retention member may be configured as a sleeve, rings, or other element that is configured to hold or retain the first retention member 312 such that the first retention member secures the car door panels 302, 304 to respective suspensions.

In a first position, the first retention member 312 may be in a locked or secured position, and in a second position, the first retention member 312 may be free to slide or move with respect to the elevator car door panel 302, 304. When the first retention member 312 is removed, the elevator car door panels 302, 304 may be released from engagement with the respective suspensions and thus may be removed from the elevator car 300. After the elevator car door panels 302, 304 are removed, a user, such as a technician, mechanic, etc., may perform a maintenance operation, such as an alignment of elements, from within the elevator car 300, rather than being on top of the elevator car. For example, after the elevator car door panels 302, 304 are removed, a close door operation may be performed to move an elevator car door coupling to the center of the opening 306, but without the panels 302, 304 blocking access thereto. Further, during this operation, the landing doors may close, and the technician may thus have easy access to the components thereof, including the landing door lock in a closed position.

In some embodiments, the first retention member 312 may be secured in the first position by one or more locking members. For example, the first retention member 312 may be secured by a key-lock mechanism. Alternatively, other securing mechanisms and means may be used to secure the first retention member 312 in the first position without departing from the scope of the disclosure.

Turning now to FIGS. 4A-4D, schematics of a process employing removable elevator car door panels similar to that shown in FIG. 3 are shown. FIGS. 4A-4D show a technician operating a first retention member, in the form of a locking tie, removing elevator door panels, and performing a maintenance operation, all from within an elevator car.

Figure 4B:
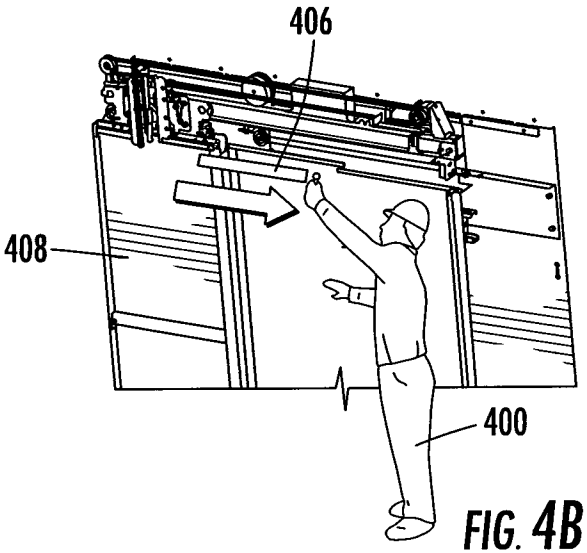
FIG. 4B is a schematic of a further step of the process started in FIG. 4A.
Figure 4D:
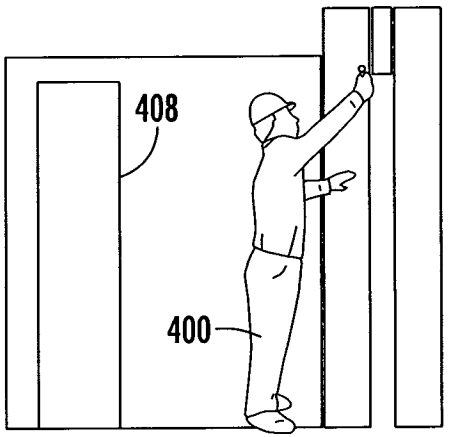
FIG. 4D is a schematic of a further step of the process started in FIG. 4A.
Figure 4A:
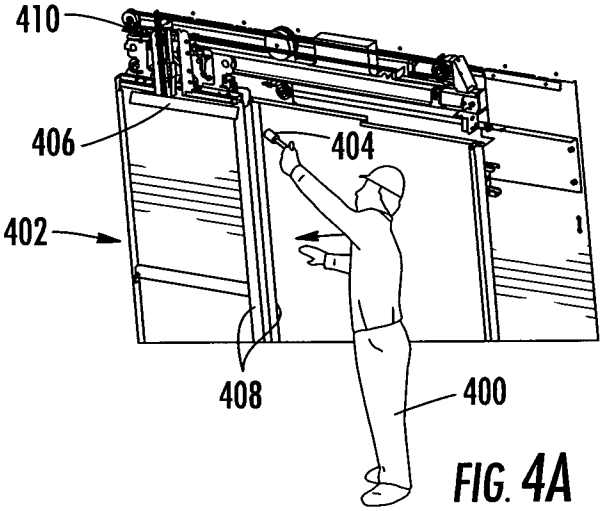
FIG. 4A is a schematic of a first step of a process in accordance with an embodiment of the disclosure.

In FIG. 4A, a technician 400 will open the elevator car door 402 and use a tool 404 to unlock a locking member that is configured to lock or secure a first retention member 406 in a first position. The first retention member is configured to releasably retain elevator car door panels 408 to suspensions and a suspension trolley 410, similar to that shown in FIG. 3. The tool 404 may be a key, or other unlocking tool, that is configured to disengage the locking member from a secured position into a released position. In the released position, the first retention member 406 may be removed.

Figure 4C:
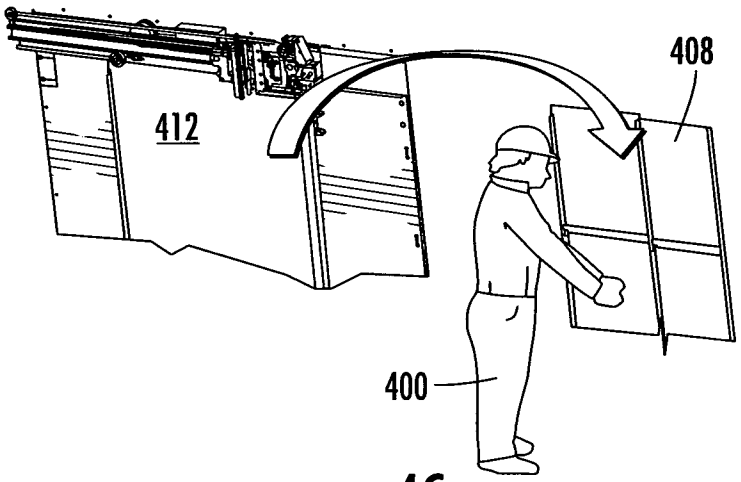
FIG. 4C is a schematic of a further step of the process started in FIG. 4A.

As shown in FIG. 4B, the technician 400 will slide the first retention member 406 out of the first position to thus release the elevator car door panels 408. This will enable the elevator car door panels 408 to be removed from the suspensions. Thus, as shown in FIG. 4C, the technician 400 may remove the elevator car door panels 408 from the elevator car door and expose the opening 412. With the elevator car door panels 408 removed from the opening 412, the technician 400 may close the elevator car door 402, and the associated landing door, to thus access the components of the elevator car door 402 and the landing door from inside the elevator car. As such, the technician 400 may perform a maintenance operation, such as an alignment of components, from inside the elevator car, as shown in FIG. 4D. After the operation is complete, the technician 400 may perform the above described process in reverse. That is, the technician 400 can reattach the elevator car door panels 408 to the suspensions, reengage the first retention member 406 to the second retention member, and then secure the first retention member 406 and thus the elevator car door panels 408 in an operational position by means of locking the locking member.

Figure 5:
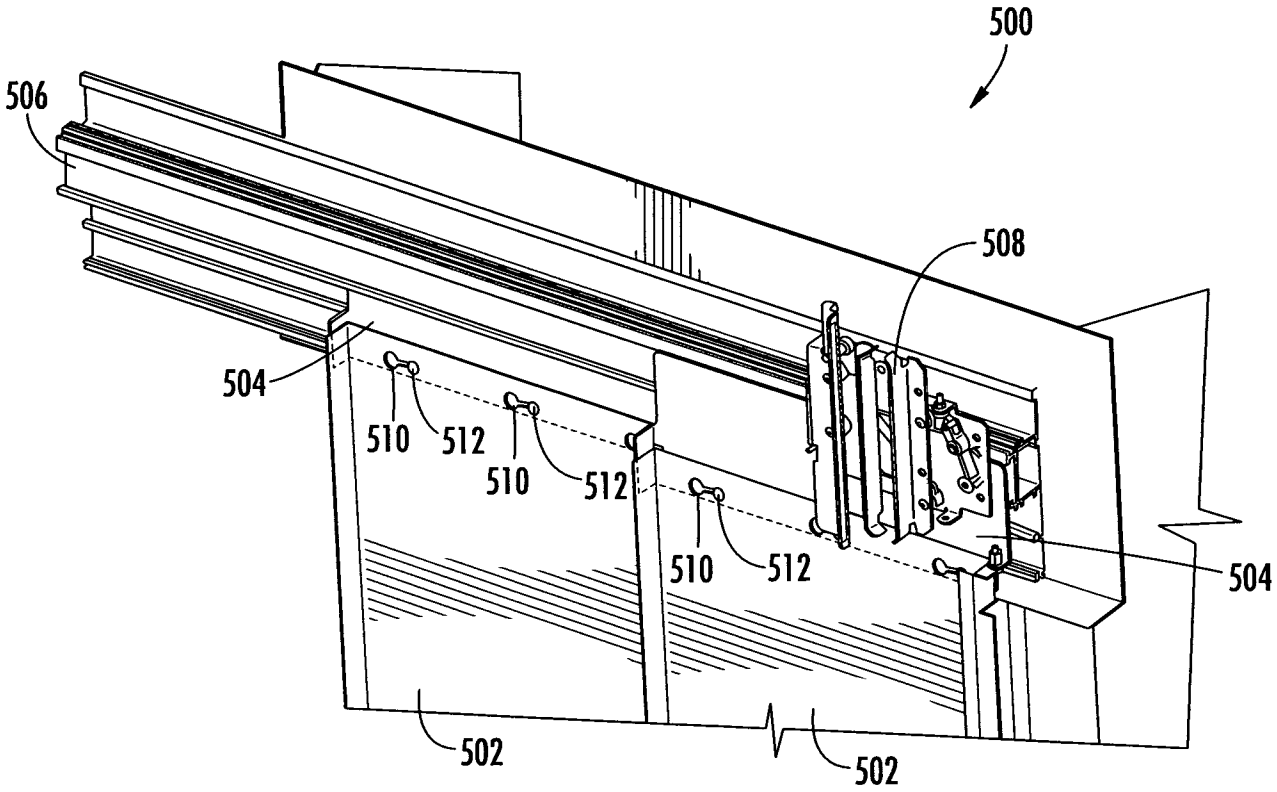
FIG. 5 is a schematic of an embodiment of an elevator car door system in accordance with the disclosure.

Turning now to FIG. 5, an alternative embodiment of a system having an elevator car door with removable panels is shown. As shown, an elevator car door 500 includes two car door panels 502 that are removably mounted on respective car door suspensions 504. The car door suspensions 504 are slidably moveable along a car door lintel 506 by a suspension trolley 508. The elevator car door panels 502 are mounted to respective car door suspensions 504 by means of first retention members 510, which may be apertures or holes in the elevator car door panels 502. The first retention members 510 of the car door panels 502 may enable second retention members 512 to fit through the first retention members 512 and to hold or retain the car door panels 502 to the car door suspensions 504. In some embodiments, the second retention members 512 may be integrally formed with the car door suspensions 504 and configured as fasteners that fasten or secure the car door panels 502 to the suspensions 504. In other embodiments, the second retention members 512 may be fasteners or other elements or structures that are welded, screwed, fastened, etc. to or with the car door suspensions 504, including but not limited to bolts, screws, nails, and/or pins.

Figures 6A, 6B, 6C:
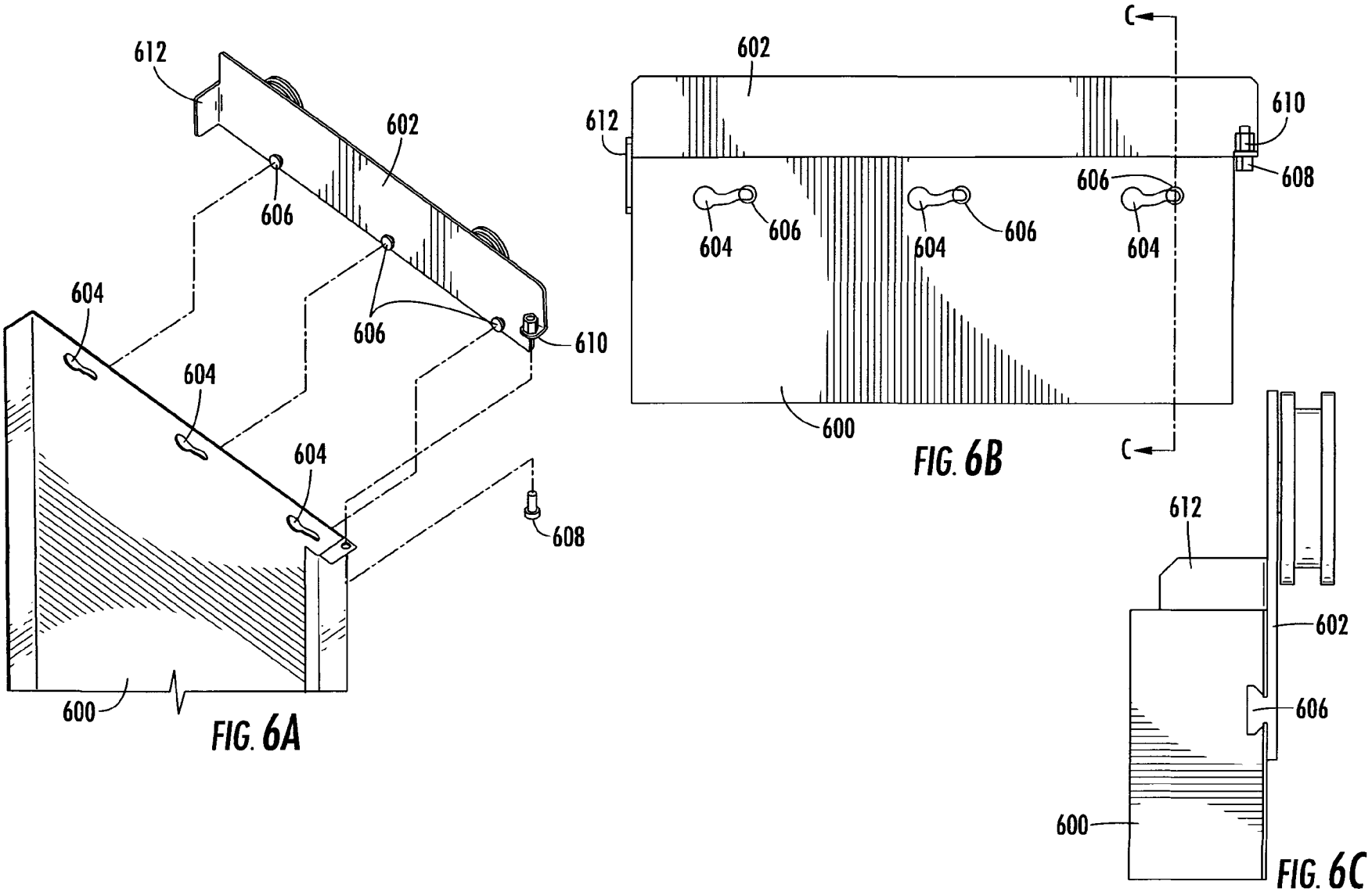
FIG. 6A is a schematic illustration of an elevator car door system in accordance with an embodiment of the disclosure.
FIG. 6B is a plan view of the elevator car door system of FIG. 6A assembled.
FIG. 6C is a side, cross-sectional view of the elevator car door system of FIG. 6B as viewed along line C-C of FIG. 6B.

Turning now to FIGS. 6A-6C, various schematic views of an embodiment similar to that shown in FIG. 5 are shown. FIG. 6A shows a schematic of a car door panel 600 in an exploded view with a car door suspension 602 and indications of how the two elements are connected. FIG. 6B shows a plan view of the car door panel 600 as retained on the car door suspension 602. FIG. 6C shows a side view, cross-sectional schematic of the car door panel 600 and car door suspension 602 of FIG. 6B along the line C-C shown in FIG. 6B.

As shown in FIG. 6A, the car door panel 600 includes a number of first retention members 604, in this embodiment the first retention member are apertures. The first retention members 604 are configured to receive and retain a similar number of second retention members 606 that are located on the car door suspension 602. When the second retention members 606 are fit within the first retention members 604, the car door panel 600 will be securely held vertically with respect to the car door suspension 602. The first retention members 604 are configured or formed to enable sliding between the car door panel 600 and the car door suspension 602, such that the car door panel 600 may be secured to the car door suspension 602. Further, as shown, an optional locking member 608 may be configured to engage with a securing member 610. The locking member 608 and the securing member 610 are configured to secure the car door panel 600 relative to the car door suspension 602 such that the car door panel 600 cannot slide relative to the car door suspension 602 when the locking member 608 is engaged.

FIG. 6B shows a plan view of the car door panel 600 retained and in a first position relative to the car door suspension 602. The first position may be a secured or locked position. That is, the first position may be an operational position of the car door panel 600. As shown, the second retention members 606 are retained within the first retention members 604 and the locking member 608 is engaged with the securing member 610. Thus, FIG. 6B shows the operational position of the car door panel 600, that is, FIG. 6B shows the configuration when the car door panel 600 is hung from the car door suspension 602 and may operate as a portion of an elevator car door.

As shown, the first retention members 604 may have an oblong geometry. That is, the first retention members 604 may have a first width portion and a second width portion. The first width portion of the first retention member 604 may have a larger width than the second width portion. The first width portion of the first retention member 604 is configured to allow the second retention member 606 to fit through that portion of the first retention member 604. The second, and narrower, width portion of the first retention member 604 is configured to allow the second retention member 606 to slide or translate within the first retention member 604 to lock or engage the car door panel 600 into a secure position. It will be appreciated that the opposite movement will enable removal of the car door panel 600 from the second retention members 606. As used herein, a first position of the car door panel 600 is shown in FIG. 6B, with a second position being when the second retention members 606 are aligned with the first width portion of the first retention members, i.e., the second position is when the car door panel 600 may be separated from the suspension 602.

FIG. 6C shows a schematic cross-sectional, side view along the cross-section of line C-C shown in FIG. 6B. As shown in FIG. 6C, the second retention member 606 may have a conic shape or configuration. As such, when the first retention member 604 of the car door panel 600 is fit over the second retention members 606, the second retention members 606 may securely fasten, retain, or hold the car door panel 600. Those of skill in the art will appreciate that other geometries and/or configurations of the second retention members may be used without departing from the scope of the disclosure. It will be appreciated that because of the conic geometry, the second retention member 606 will fit through the first width portion of the first retention member 604, but once moved into the second width portion of the first retention member 604 the narrow conic section of the second retention member 606 will be held and retained therein.

Also shown in FIGS. 6A-6C, the car door suspension 602 may include an optional stop 612 located at an end of the car door suspension 602. The stop 612 may be configured to assist in aligning the car door panel 600 relative to the car door suspension 602.

Turning now to FIGS. 7A-7G, a process of removing an elevator car door panel and performing a maintenance operation is schematically shown. The mechanism employed in the embodiment of FIGS. 7A-7G is similar to that shown in FIGS. 5 and 6A-6C.

Figure 7B:
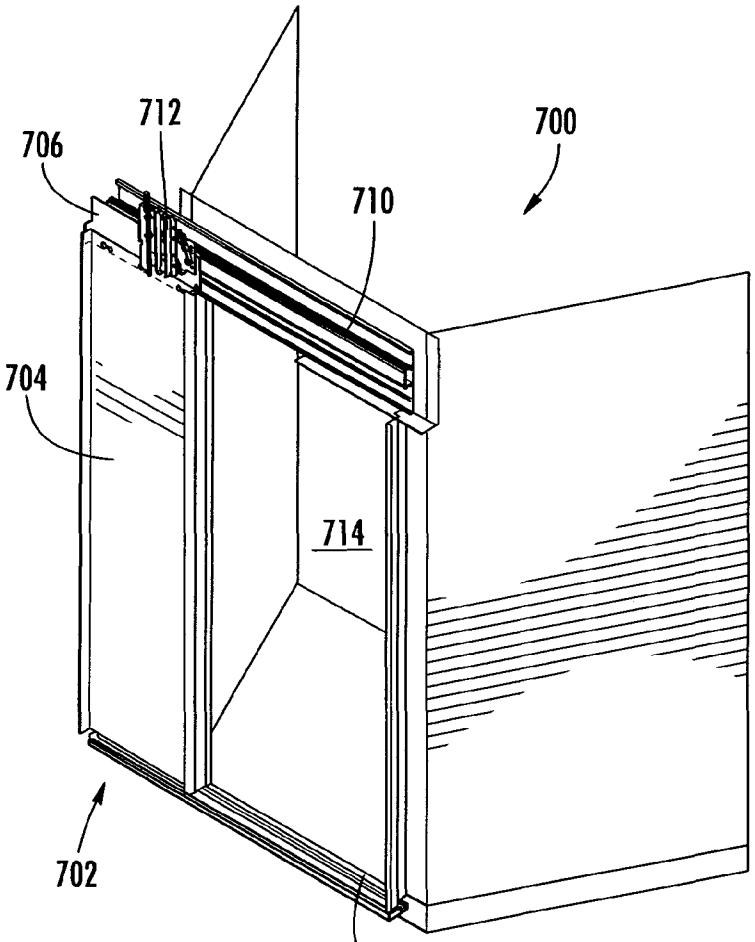
FIG. 7B is a schematic of a further step of the process started in FIG. 7A.
Figure 7A:
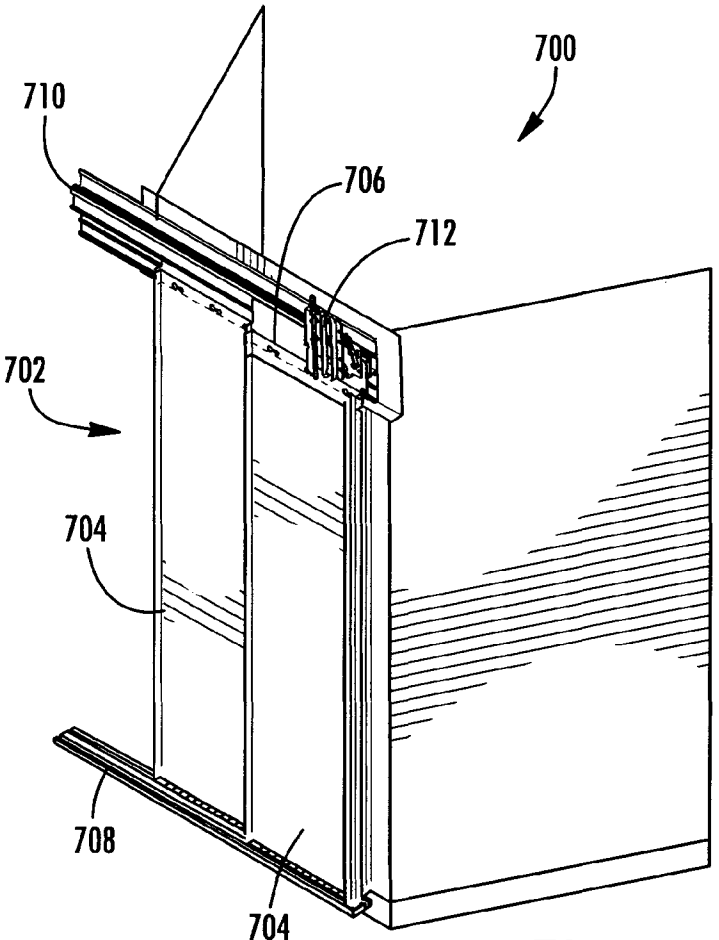
FIG. 7A is a schematic of a first step of a process in accordance with an embodiment of the disclosure.

An elevator system 700 includes an elevator door 702 that may be opened (FIG. 7B) and closed (FIG. 7A). The elevator door 702, as shown in FIG. 7A, includes two door panels 704. The door panels 704 are each retained at a top to a suspension 706 and are supported and slidably move within a track 708 at a bottom of the door panels 704. The suspensions 706 are slidably retained and moveable along a lintel 710 by means of a suspension trolley 712. FIG. 7A shows a first step of removing the car door panels 704 and performing a maintenance operation. At this first step, the car door 702 is closed and a technician that wants to adjust and/or check the car and landing door locks is located inside the elevator car.

Next, the technician will open the elevator car door 702 as shown in FIG. 7B, that is, the elevator car door 702 will be moved to an open state (FIG. 7B) from a closed state (FIG. 7A). As shown, the door panels 704 are moved to the side and an elevator car door opening 714 is formed. It will be appreciated that both the elevator car door 702 and a landing door that is adjacent the elevator car door 702 will be opened simultaneously. The elevator car door 702 may be opened by operation of a button or switch that is within the elevator system 700, such as on an elevator car operating panel.

Figure 7D:
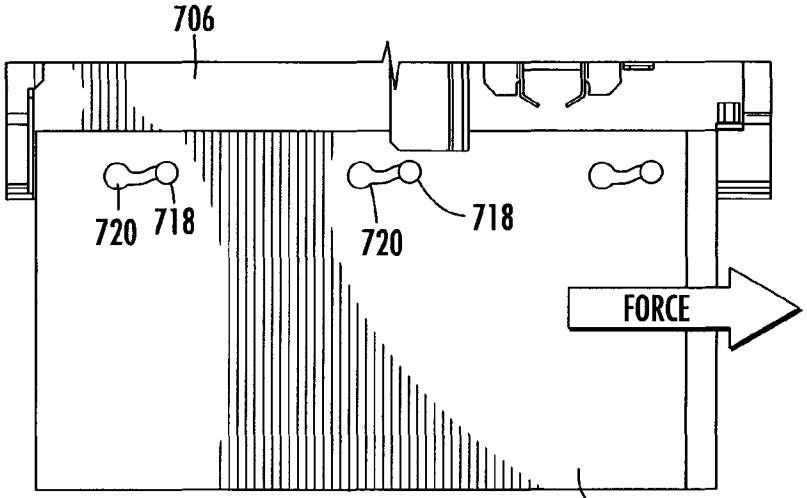
FIG. 7D is a schematic of a further step of the process started in FIG. 7A.
Figure 7E:
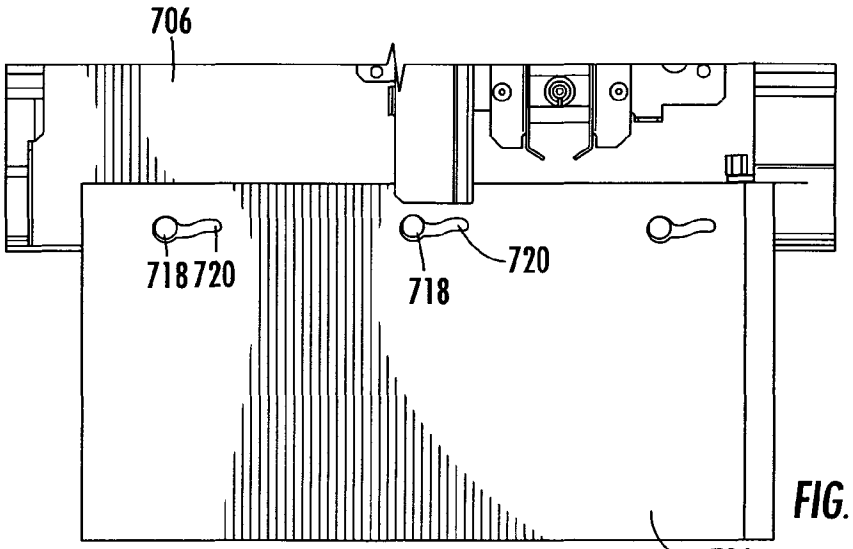
FIG. 7E is a schematic of a further step of the process started in FIG. 7A.
Figure 7C:
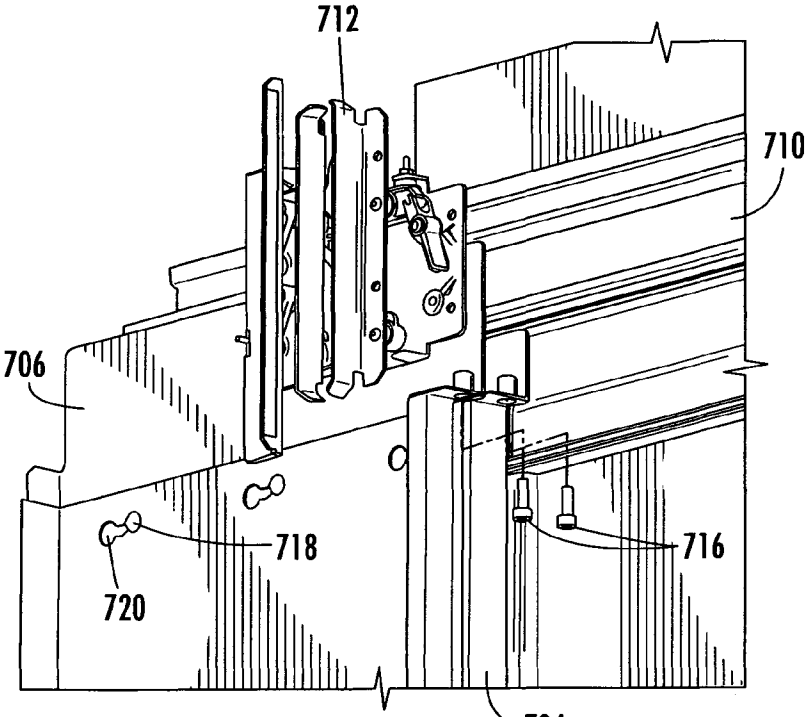
FIG. 7C is a schematic of a further step of the process started in FIG. 7A.

Next, as shown in FIG. 7C, the technician may remove a locking member 716 for each of the car door panels 704. Removal of the locking members 716 enables the car door panels 704 to be moved relative to the suspensions 706 to which they are attached. For example, the car door panels 704 may be moved from first position to a second position. In some embodiments, the first position may be a secured position and a second position may be a removable position. The locking members 716 may be screws, bolts, and/or other types of fasteners or locking elements.

Next, as shown in FIG. 7D, the car door panel 704 is located in a first position. However, the car door panel 704 may be shifted relative to the suspension 706 by the application of force. As a technician applies force to the car door panel 704, as shown by the arrow in FIG. 7D, the car door panel 704 may move relative to the suspension 706 by a sliding and/or translating motion. The movement is guided by one or more second retention members 718 of the suspension 706 sliding within first retention members 720 of the car door panel 704. The translation or movement of the car door panel 704 is shown, relatively, in the difference between FIG. 7D and FIG. 7E, where the retention members 718 are aligned with the first width portion of the first retention members 720. Moving from the configuration of FIG. 7D to the configuration of FIG. 7E is a movement from a first position to a second position. As such, in the second position, the car door panel 704 is no longer fixed to the suspension 706 and may be removed therefrom.

Figure 7G:
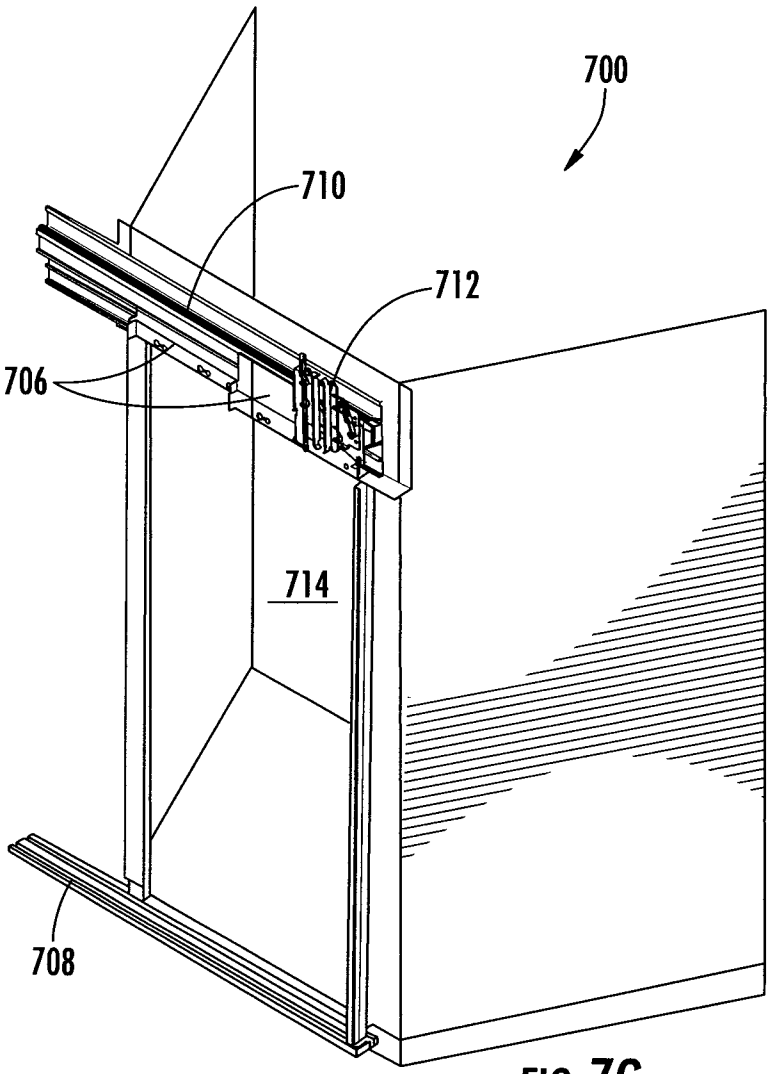
FIG. 7G is a schematic of a further step of the process started in FIG. 7A.
Figure 7F:
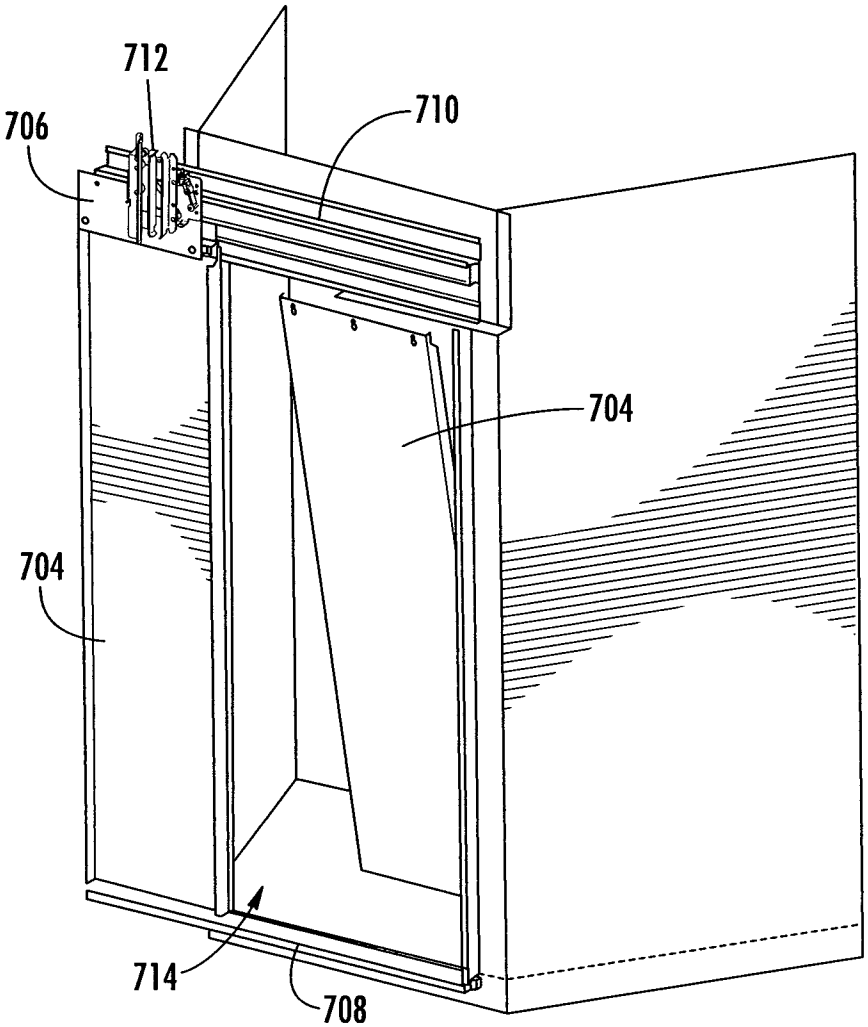
FIG. 7F is a schematic of a further step of the process started in FIG. 7A.

Next, as shown in FIG. 7F, the car door panel 704 may be moved along the track 708 and removed from the elevator system 700 through the opening 714. The process may be repeated to remove the second car door panel 704 shown in FIG. 7F. During this process, the car door panels 704 may be stored in the elevator car with the technician or in some other location.

Next, as shown in FIG. 7G, after having removed the car door panels 704, the technician may activate the car door closing operation on an operating panel. That is, the elements of the elevator car door 702 may be moved back to a closed state, even with the elevator car door panels 704 removed. By performing this operation, the landing door will also close. As shown in FIG. 7G, the suspensions 706 and the suspension trolley 712 are in the closed state or position, but the opening 714 is still present, enabling a technician to view the landing door and associated components. With the car door panels 704 removed, the technician can align the elements of the elevator car system 700 with the elements of the landing door(s), all from within the elevator car. Further, in the state shown in FIG. 7G, a technician can move the elevator car up and down within an elevator shaft by using operational buttons within the elevator car. Thus, the technician can check and/or align the appropriate elements and components for each landing door within the elevator shaft. Once the maintenance operations are complete, the technician may perform the opposite order of steps shown in FIGS. 7A-7G to replace the elevator car door panels 704 back to an operational state.

Figure 8:
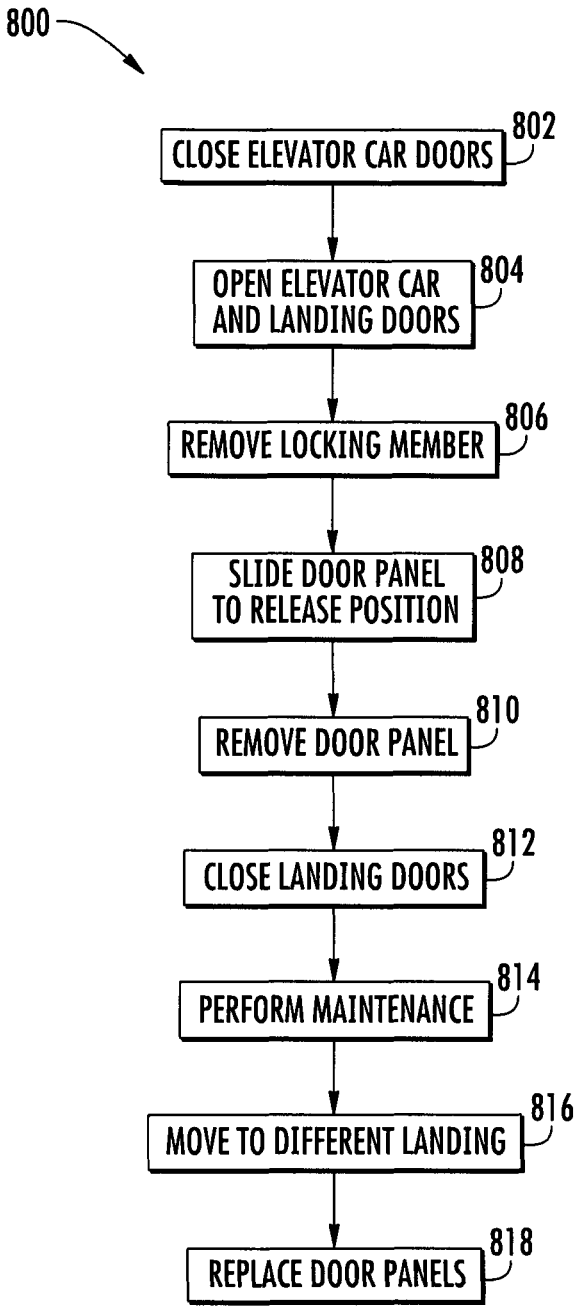
FIG. 8 is a flow chart showing a method of removing an elevator car door panel and performing a maintenance operation in accordance with the disclosure.

Turning now to FIG. 8, a method of removing an elevator car door panel and performing a maintenance operation is shown. Process 800 may be similar to the processes described above, and may be used for any type of elevator car door panel that is configured or arranged to be removed from within an elevator car, including the configurations described above.

At step 802, a technician enters an elevator car and closes the elevator car door. At this step, the technician may place the elevator in a specific operating mode, such as a maintenance mode. The technician may also move the elevator car to a desired floor within the elevator shaft, such as a specific floor to be inspected or have maintenance performed thereon.

At step 804, the technician opens the elevator car door and the landing door simultaneously. That is, the technician may open the doors of the elevator system as would be done normally. This will place the elevator car door panels in an open position, exposing the securing and locking elements of the elevator car door panels.

At step 806, the technician may access and remove a locking member, such as a screw, bolt, etc. that is configured to lock or secure the car door panels to suspensions. In some embodiments, removing the locking member may be a process of unlocking a locking tie or similar feature.

At step 808, the technician may pull or move an elevator car door panel relative to the suspension the panels were previously fixedly attached to, and translate the panel from a first position (see, e.g., FIG. 7D) to a second position (see, e.g., FIG. 7E). In some embodiments the first position may be a secured position and the second position may be a release position. During step 808 the elevator car door panel may move relative to one or more second retention members that are attached to or part of the suspension that supports the panel when in the first position.

At step 810, the technician may remove the elevator car door panels from the suspensions. The panel may be completely removed from the opening of the elevator car, and the panel may be stored within the elevator car, or elsewhere.

Steps 806-810 may be performed for each elevator car door panel that is on the elevator car.

At step 812, the technician may operate the close door function. That is, the landing doors may be closed in tandem with the elements of the elevator car doors, but without the car door panels present. This will enable the technician to access the landing door lock from inside the elevator car in order to inspect and adjust the landing door lock with the car door coupling.

At step 814, the technician may perform an alignment and/or maintenance operation. For example, the technician may check or correct the alignment of the car door lock with the landing door lock from inside the elevator car.

At step 816, the technician may move the elevator car, without the elevator car door panels present, to another floor to perform additional maintenance operations at every floor required or desired.

Finally, at step 818 the reverse process of steps 802-812 may be performed to replace the elevator car door panels on the elevator car to form the elevator car door.

Advantageously, embodiments described herein provide systems and processes for performing elevator car maintenance from inside an elevator car. For example, advantageously, embodiments disclosed herein enable a technician to perform adjustment or other tasks associated with elevator car door locks and landing door locks from within an elevator car. Advantageously, embodiments disclosed herein eliminate the need for a technician to be located on top of an elevator car to perform the maintenance operations.

Further, advantageously, embodiments disclosed herein, provide a simple way of removing elevator car door panels. Moreover, advantageously, because a technician may no longer be required to access various components from outside of the elevator car, embodiments disclosed herein may enable the reduction of safety spaces or volumes within an elevator shaft.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, with respect to the embodiments of FIGS. 5-7G, although described herein as the second retention members being part of or attached to the suspension, in alternative embodiments, the second retention members may be part of or attached to the elevator car door panels, and the associated first retention members may be in the suspension. Those of skill in the art will appreciate that other variations on the configurations may be achieved without departing from the scope of the disclosure. Further, although shown and described with respect to an elevator car door that includes two panels that are operated from a single side of the elevator, those of skill in the art will appreciate that other elevator car door configurations may employ embodiments disclosed herein. For example, elevator doors that open and close from both or opposite sides of an opening may employ the features disclosed herein.

Furthermore, for example, although described herein as mechanical retention members and configurations, those of skill in the art will appreciate that an electromechanical link between the car door suspension and the car door panels may be employed. Additionally, magnetic connections, energized connections, or other types of connections may be employed as the retention members.

Accordingly, the present disclosure is not to be seen as limited by the foregoing description, but is only limited by the scope of the appended claims.

What is claimed is:

1. An elevator car door system comprising:

an elevator car door panel having a first retention member; and a suspension having a second retention member configured to releasably engage with the first retention member to retain the elevator car door panel in a first position;

wherein the elevator car door panel is moveable relative to the suspension to a second position, wherein the second position is configured to enable the elevator car door panel to be removed from the suspension.

2. The system of claim 1, wherein one of the first retention member and the second retention member is at least one fastener.

3. The system of claim 1, wherein the other of the first retention member and the second retention member is at least one aperture.

4. The system of claim 3, wherein the at least one aperture includes a first width and a second width, wherein the first width is larger than the second width, and wherein the first width is sized to permit the at least one fastener to pass therethrough and the second width is sized to prevent the at least one fastener to pass therethrough.

5. The system of claim 1, wherein the first retention member and the second retention member form an electromechanical link between the car door panel and the suspension.

6. The system of claim 1, wherein the number of first retention members equals the number of second retention members.

7. The system of claim 1, wherein the first retention member is a locking tie.

8. The system of claim 1, wherein the suspension further comprises a stop element configured to assist in the placement of the elevator car door panel relative to the suspension.

9. The system of claim 1, further comprising a locking member configured to secure the elevator car door panel to the suspension in the first position.

10. The system of claim 1, wherein at least one of the first retention member and the second retention member is accessible from an inside of an elevator car.

* * * * *